US012584692B2

(12) United States Patent
Unton et al.

(10) Patent No.: US 12,584,692 B2
(45) Date of Patent: Mar. 24, 2026

(54) HEAT EXCHANGER WITH FAILURE TOLERANCE

(71) Applicant: Rolls-Royce North American Technologies Inc., Indianapolis, IN (US)

(72) Inventors: Timothy Unton, Indianapolis, IN (US); Eric Donovan, Indianapolis, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 182 days.

(21) Appl. No.: 18/344,535

(22) Filed: Jun. 29, 2023

(65) Prior Publication Data

US 2025/0003688 A1 Jan. 2, 2025

(51) Int. Cl.

| | |
|---|---|
| ***F28D 1/04*** | (2006.01) |
| ***F28D 7/00*** | (2006.01) |
| ***F28D 9/00*** | (2006.01) |
| *F28D 21/00* | (2006.01) |

(52) U.S. Cl.

CPC ..... *F28D 1/0435* (2013.01); *F28D 7/0066* (2013.01); *F28D 9/0093* (2013.01); *F28D 2021/0028* (2013.01)

(58) Field of Classification Search

CPC ..... F28D 1/0435; F28D 2021/0028; F28D 9/0093; F28D 7/0066

See application file for complete search history.

(56) References Cited

U.S. PATENT DOCUMENTS

| | | | | |
|---|---|---|---|---|
| 2,179,702 | A * | 11/1939 | Saunders | F28F 9/0243 165/151 |
| 8,844,610 | B2 | 9/2014 | Platt | |
| 9,562,708 | B2 | 2/2017 | Medlock et al. | |
| 2004/0007349 | A1* | 1/2004 | Youn | F28D 5/02 165/115 |
| 2004/0159424 | A1* | 8/2004 | Reinke | F28F 13/08 165/140 |
| 2004/0182555 | A1* | 9/2004 | Lagerstrom | F28F 3/046 165/166 |
| 2006/0123796 | A1 | 6/2006 | Aycock et al. | |

(Continued)

FOREIGN PATENT DOCUMENTS

| | | | |
|---|---|---|---|
| DE | 102012206127 | A * | 10/2013 |
| FR | 980947 | A * | 5/1951 |
| JP | H11294973 | A * | 10/1999 |

OTHER PUBLICATIONS

Translation of JPH11294973A named Translation—JPH11294973A (Year: 1999).*

(Continued)

*Primary Examiner* — Paul Alvare

(74) *Attorney, Agent, or Firm* — Barnes & Thornburg

(57) ABSTRACT

A heat exchanger may include a first coolant path for circulating a first coolant and a second coolant path for circulating a second coolant, where the first coolant path including a plurality of first cooling tubes, where the second coolant path including a plurality of second cooling tubes, where the first coolant path is fluidly isolated from the second coolant path in the heat exchanger, and where the first cooling tubes and the second cooling tubes are arranged in series and such that the first cooling tubes alternate with the second cooling tubes in an airflow direction.

16 Claims, 6 Drawing Sheets

(56) References Cited

U.S. PATENT DOCUMENTS

| | | | | |
|---|---|---|---|---|
| 2006/0180703 | A1* | 8/2006 | Zielinski | F28D 7/0066 244/57 |
| 2008/0078537 | A1* | 4/2008 | Desai | F28F 27/02 165/140 |
| 2008/0121381 | A1* | 5/2008 | So | F28D 9/0093 165/140 |
| 2009/0154091 | A1* | 6/2009 | Yatskov | F28F 1/022 165/104.33 |
| 2010/0281879 | A1 | 11/2010 | Shapiro et al. | |
| 2011/0056667 | A1* | 3/2011 | Taras | F28F 9/0275 165/173 |
| 2014/0202661 | A1* | 7/2014 | Goenka | B60H 1/00335 165/104.13 |
| 2017/0211896 | A1* | 7/2017 | Schwalm | F28F 1/40 |
| 2018/0142956 | A1* | 5/2018 | Freund | F28F 1/12 |
| 2020/0025380 | A1 | 1/2020 | Sandoval | |
| 2021/0190433 | A1* | 6/2021 | Loiacano | F28D 7/16 |
| 2024/0125564 | A1* | 4/2024 | Snyder | F28D 9/00 |

OTHER PUBLICATIONS

Translation of DE102012206127A named Translation—JDE102012206127A (Year: 2013).*

Translation of FR980947A named Translation—FR980947A (Year: 1951).*

* cited by examiner

HEAT EXCHANGER WITH FAILURE TOLERANCE

TECHNICAL FIELD

The present disclosure relates to heat exchangers, and more specifically, to a heat exchanger for moving heat from fluid (e.g., air) flowing through the heat exchanger to a single-phase or two-phase coolant flowing within the heat exchanger.

BACKGROUND

Electronics system, such as data centers, may have one or more electronic components that generate a tremendous amount of heat. A data center is a facility that provides access to applications and data with a complex network including computing and storage structures. In some cases, an electronics rack can contain several of the data center's electronics subsystems, each containing one or more heat-generating components that need cooling. Heat must be removed to prevent damaging the equipment and to ensure systems remain online continuously. The present disclosure relates to new and improved heat exchangers for removing this heat with several advantages over existing versions.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

As discussed in the background above, heat exchangers are often used to transfer heat away from heat-generating devices, such as electronics racks within a data center. Since cooling systems also use energy, there is always a desire for increasing the efficiency of such systems to lower total energy costs and reduce environmental impact. the. At the same time, redundancy is desirable to ensure the cooling system's reliability, particularly when it is critical that the data center remains online at all times. The embodiments discussed herein, and variations thereof, provide a new and improved heat exchanger with failure-tolerant characteristics (such as redundancy) without substantial sacrifices to efficiency. While the embodiments described below are generally referenced in the context of a data center, those skilled in the art will appreciate that their features are also applicable to heat exchangers in a wide variety of other fields.

Figure 1:
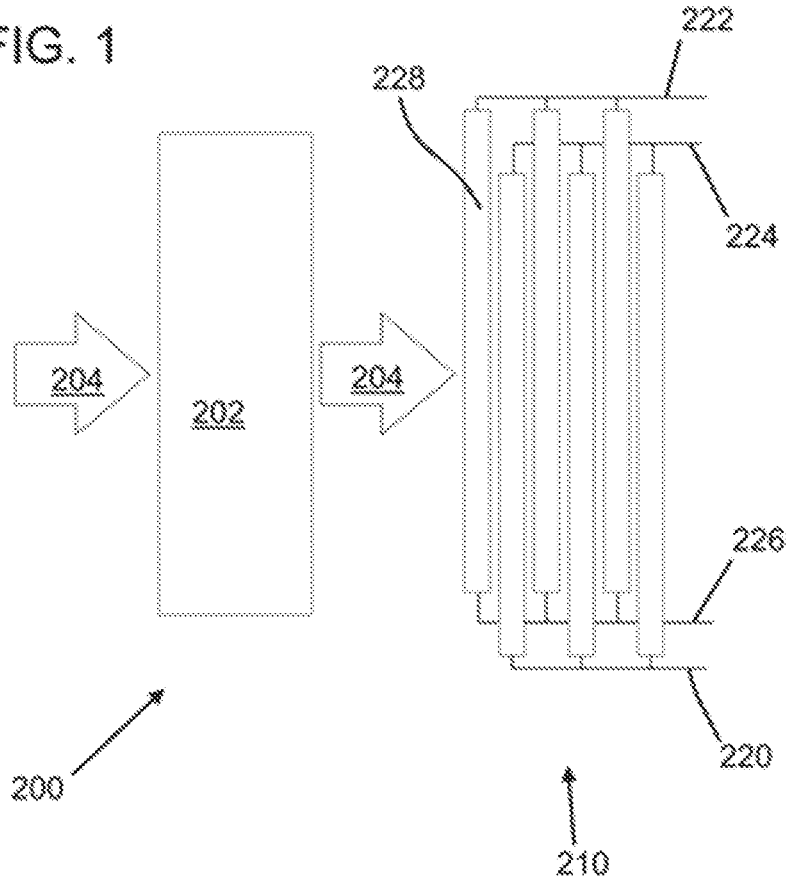
FIG. 1 is a diagram showing a failure-tolerant cooling apparatus having a heat exchanger with multiple coolant paths in accordance with certain aspects of the present disclosure.

FIG. 1 shows an example of a cooling apparatus 200 for cooling an electronics rack 202 and/or other subsystem in a data center. In the depicted embodiments, the cooling apparatus 200 utilizes a "air-to-coolant" heat exchange method for moving heat away from the electronics rack 202 and ultimately out of the data center. E.g., the depicted embodiment first removes heat from the electronics rack 202 via flowing air 204 (where circulation of the air may be caused or at least enhanced by a fan with an adjustable fan speed). The air may be continuously circulated within the data center to ensure consistent conditions, though utilizing outside air is also contemplated. A heat exchanger 210 may be positioned such that it receives heated air after it is exhausted from the electronics rack.

The heat exchanger 210 is configured to transfer heat from the heated air to a coolant flowing therein. The coolant may be any suitable cooling medium. In certain exemplary embodiments, the coolant may be fluid that is circulated through the heat exchanger, maintaining a liquid form. For example, water or a liquid refrigerant may be used as the coolant, where the coolant does not reach its boiling point during normal operation of the cooling apparatus. Another option would be one or more engineered fluids (e.g., dielectrics) that are designed to remain in a single phase, at least within the relevant temperature and pressure ranges. In other embodiments, a two-phase cycle may be used, where the coolant changes phases at different locations in the cooling cycle. In other words, the coolant may be at least partially vaporized (changed from a liquid to a gas) in the heat exchanger 210 as it collects heat from the air 204. Herein, in the context of two-phase cooling, "quality" of the coolant is defined as a measure of the state of the coolant, specifically the vapor-liquid mixture that exists at an outlet of the heat exchanger 210. Further, "quality" of the coolant is expressed as a percentage or a decimal between 0 (or 0%) and 1 (or 100%), where a quality of 0/0% indicates that the coolant is entirely liquid, while a quality of 1 (or 100%) indicates that the coolant is entirely vapor.

Several types of coolants may be used in a two-phase cooling cycle, including (but not limited to) water, refrigerants, and hydrocarbons. Water is a common coolant used in two-phase cooling cycles due to its excellent thermal properties, low cost, and availability. Refrigerants, such as R134a and R245fa, have good heat transfer properties and are suitable for high-temperature applications. Hydrocarbons, such as propane and butane, are also used as coolants in two-phase cooling cycles due to their low global warming potential and high energy efficiency. The selection of the coolant type depends on the specific application requirements, including cooling performance, cost, safety, dielectric properties, and/or environmental concerns.

Figure 2:
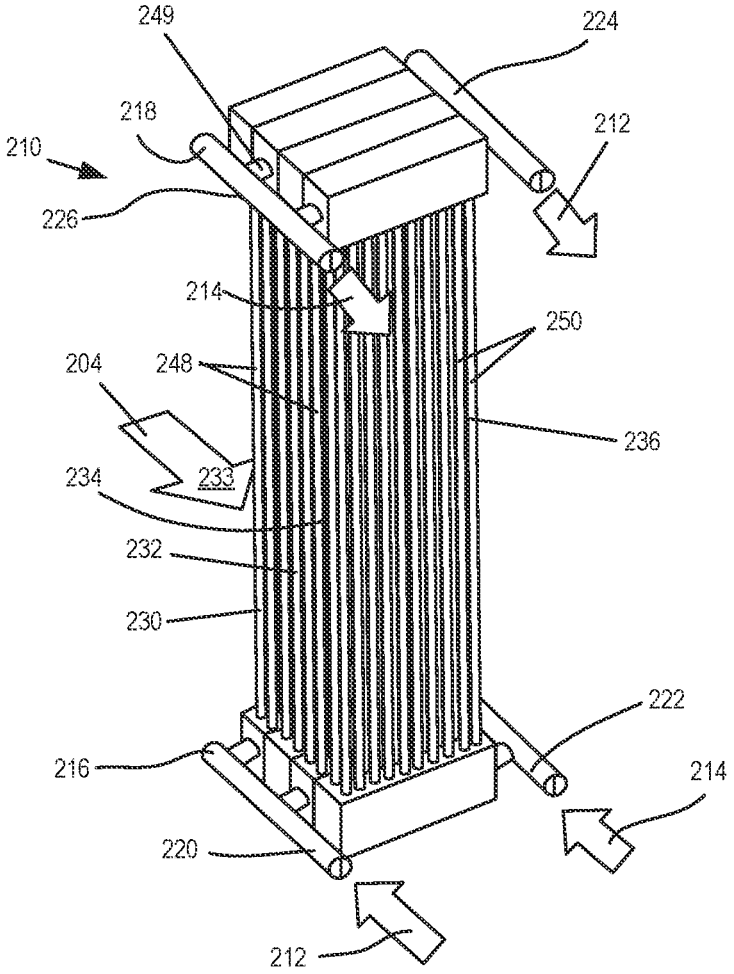
FIG. 2 is an illustration showing a perspective view of a heat exchanger having multiple coolant paths provided via alternating heat exchanger modules in accordance with certain aspects of the present disclosure.

To provide failure tolerance, the heat exchanger 210 may have two (or more) different coolants (which may be the same coolant type) that flow through distinct, fluidly-isolated coolant paths. For example, as shown in FIG. 2, a first coolant 212 may flow through a first coolant path 216 and a second coolant may flow through a second coolant path 218. The first coolant path 216 may include a first inlet 220 (shown as an inlet manifold) and a first outlet 224, while the second coolant path 218 may similarly have a second inlet 222 and a second outlet 226. As discussed in more detail below, each of the first and second cooling paths may have one or more heat exchanger modules 228 with features for removing heat from the air. The first coolant 212 and the second coolant 214 may be the same coolant type (e.g., the same refrigerant type) and perhaps even sourced from a common coolant reservoir, but certain embodiments may call for the first coolant 212 to be different in coolant type from the second coolant 214.

The first coolant path 216 and the second coolant path 218 remain wholly distinct, meaning fluidly isolated, within the heat exchanger 210. In some embodiments, the first coolant 212 and the second coolant 214 may have a common source (e.g., a common coolant reservoir and/or pump), but certain exemplary embodiments also separate these components such that each coolant path is entirely self-sufficient relative to the other. Similarly, the first coolant path 216 may share a condenser (or other device for removing heat from the exhausted coolant) with the second coolant path 218. When a condenser is included (which is not shown), the condenser may be located outside the cabinet and configured to remove heat from the coolant prior to its recirculation. Alternatively, each coolant path may have a dedicated condenser or similar heat-removal device.

Separating the heat exchanger 210 into two (or more) cooling paths, as described and contemplated herein, has at least two primary advantages. First, the heat exchanger 210 has failure-tolerant characteristics because if one of the cooling paths fails, the other may continue its operation. Thus, each of the two cooling paths may be configured (e.g., sized and otherwise designed) such that it can handle the entirety of a normal heat load required to maintain the electronics cabinet or other system under normal conditions (e.g., the "operational heat load"). If a size reduction is desired (e.g., to save cost), each cooling path may be sized in a manner such that it can handle at least a minimum heat load of an electronics cabinet or other system, which may be a minimum heat exchange rate that prevents damage to the system, even if full normal operation is not achievable, for a time period until maintenance can be completed (e.g., the "minimum heat exchange rate").

Second (and as discussed in more detail below), the particular alternating orientation of certain cooling elements, such as the heat exchanger modules shown in FIG. 2, may allow each of the first coolant path 216 and the second coolant path 218 to be of similar size and capabilities and operate at a similar efficiency rate during normal operation. Sizing these two cooling paths and their respective components similarly may substantially lower the overall energy consumption of the cooling apparatus 200 relative to existing devices. For example, the inventors recognized that simply placing two prior-art heat exchangers in series would result in the "first" (i.e., airflow-facing) heat exchanger handling a significant majority of the heat load relative to the second heat exchanger, assuming they are sized the same. This occurs since the air temperature of flowing air drops as it moves through a heat exchanger, and heat transfer is maximized with temperature differential. As a result, sizing the "second" heat exchanger with failure characteristics in mind (meaning it could handle an entire heat load if the first heat exchanger failed) would mean the second heat exchanger would have to be oversized, and most of the heat capacity of the second heat exchanger would remain unused/wasted during normal conditions. The embodiments herein address this issue by alternating cooling elements (in series) of the first coolant path 216 with those of the second coolant path 218, multiple times. Thus, while air temperature still drops as the air passes through the heat exchanger 210, the air temperature drops a minimal amount between consecutive heat modules 228, and the overall heat load handled by the first coolant path 216 and the second coolant path 218 is similar during normal conditions. As discovered by the inventors, this feature also reduces the degree of "oversizing" necessary for each of the first coolant path 216 and the second coolant path 218.

While a variety of sizing conditions are contemplated, one particular embodiment with the advantages discussed in the paragraph above include a first coolant path 216 and a second coolant path 218 where the quality of coolant within each reaches at least 30% when the system is under normal operational conditions (without failure), such as at least 50% quality. These ranges ensure a high degree of operational efficiency while also providing additional heat-capacity margin such that both coolant paths can handle the entire heat load alone, upon failure of the other. Thus, in a failure condition of the second coolant path 218, the first coolant path 216 may operate such that a quality of about 100% (or slightly less) is reached when an adequate amount of heat is removed to prevent system damage. Similarly, the second coolant path 218 may be capable of handling the minimum heat exchange rate alone while remaining at, or less than, 100% quality of its respective coolant.

Optionally, operation of both the first coolant path 216 and the second coolant path 218 includes circulation of the same nominal flow rate in both paths. Advantageously, if one coolant path were to fail or go down for maintenance, the flow rate of the other path could be increased by increasing the pump speed, allowing for more heat transfer (therefore covering for the fluid path experiencing downtime). This feature may save on energy costs because if a fluid circuit is operating at a lower flowrate (e.g., lower than a max flow rate that may be used during a failure state of the opposite path) during normal operational conditions, it has lower pressure losses that must be overcome (typically a square relationship with flow). As a result, the pump's power consumption is respectively low during normal operation, but still capable of removing the heat via a speed-up during failure or maintenance conditions (with a temporarily-higher power draw).

FIG. 2 shows a particular embodiment of the heat exchanger 210 shown via the diagram of FIG. 2. Referring to FIG. 2, the first coolant path 216 is included for circulating the first coolant 212 and the second coolant path 218 for circulating the second coolant 214. In accordance with certain advantages and features discussed above, the first coolant path 216 is preferably fluidly isolated from (i.e., not in fluid communication with) the second coolant path 218 within the heat exchanger 210, although fluid communication between the two respective coolants is possible at another location (i.e., at a common reservoir place upstream of one or more coolant pumps). The first coolant path 216 generally includes a set of cooling modules, herein depicted as a first cooling module 230 and a third cooling module 234. While only two modules are shown, more or fewer are contemplated for the first coolant path 216. Similarly, the second coolant path 218 generally includes a separate set of cooling modules, in this case a second cooling module 232 and a third cooling module 234. Importantly, the modules of the first coolant path 216 are arranged in an alternating pattern with the modules of the second coolant path 218 (e.g., such that the second cooling module 232 is between the first cooling module 230 and the third cooling module 234, and the third cooling module 234 is between the second cooling module 232 and the fourth cooling module 236).

Each of the cooling modules includes one or more cooling tubes 248, 250. In the context of this description, a "cooling tube" is defined as a thermally conductive, elongated cooling device (often in the form of a cylindrical tubes, although not required) that is positioned within the flow path a fluid cooling medium flowing through the heat exchanger 210, such as the air 204. Cooling tubes can be made from a variety of materials, including copper, aluminum, stainless steel, and titanium. The design of the cooling tube, including its size and shape, can also vary depending on the specific application and the amount of heat that needs to be transferred. In some cases, cooling tubes may be combined with other types of heat transfer surfaces, such as fins, to increase the surface area and improve the heat transfer efficiency. Also, while the cooling tubes depicted in the figures are generally uniform in size and shape, the size, shape, and other characteristics of different cooling tubes may vary. Herein, the cooling tubes of the first coolant path 216 and second coolant path 218 may be respectively referenced as "first cooling tubes" and "second cooling tubes," and it is contemplated that additional cooling tubes falling outside of these subsets may be included in the heat exchanger 210.

As shown in FIGS. 1-2, as the air 204 (FIG. 2) flows through the heat exchanger 210, it first flows through the first module 230 then follows sequentially through the second module 232, third module 234, and fourth module 236. As such, the first cooling tubes 248 and the second cooling tubes 250 are arranged (1) in series in the airflow direction, and (2) in an alternating manner in the series. The same is true of the heat exchanger modules of the respective first coolant path 216 and the second coolant path 218. Notably, "alternating" as discussed herein does not require a strict 1-to-1 alternation pattern, where each item is followed immediately by its opposite. Instead, "alternating" can refer to a pattern where multiple cooling tubes one type are followed by one or more cooling tubes of the other type before switching back.

In some embodiments (including the embodiment of FIG. 2), the cooling modules of the first coolant path 216 may include a common inlet manifold and/or outlet tube, depicted here as the first inlet manifold 220 and the first outlet tube 224. Similarly, the second coolant path 218 may include the second inlet manifold 222 and the second outlet tube 226. The inlet manifolds and outlet tubes may lead to other features of the coolant circuit, such as an evaporator, pump, reservoir, etc. The cooling modules may couple to the inlet manifolds 220, 222 via separate inlet interfaces 249, which may optionally include flow-controlling features, such as orifices, to ensure an appropriate flow rate and/or pressure within the heat exchanger 210.

Notably, all of the cooling modules depicted in FIG. 2 are generally the same structure, but they are oriented differently depending on which cooling path they are associated with. That is, the first cooling module 230 and the third cooling module 234 are substantially the same in size and shape, and they are oriented the same way such that they engage the first inlet manifold 220 and the first outlet tube 224 via their respective inlet and outlet interfaces. The second cooling module 232 and the fourth cooling module 236 are also the same size and shape as the others, but they are rotated 180 degrees such that they engage the second inlet manifold 222 and the second outlet tube 226 via their respective interfaces. Advantageously, manufacturing and assembly of the heat exchanger 210 of this embodiment may be simplified relative to other embodiments, and particular sequential patterns of the first coolant path 216 and the second coolant path 218 in the airflow direction may be customized for a particular cooling application without redesigning new module types. To accommodate the particular structure of the heat exchanger modules of FIG. 2, the first inlet manifold 220 may be located diagonally opposite the first outlet tube 224 (i.e., on an opposite side of the heat exchanger from the first outlet in a longitudinal direction of the first cooling tubes, and also on an opposite side of the heat exchanger from the first outlet in a direction that is perpendicular to the longitudinal direction of the first cooling tubes).

Figure 3:
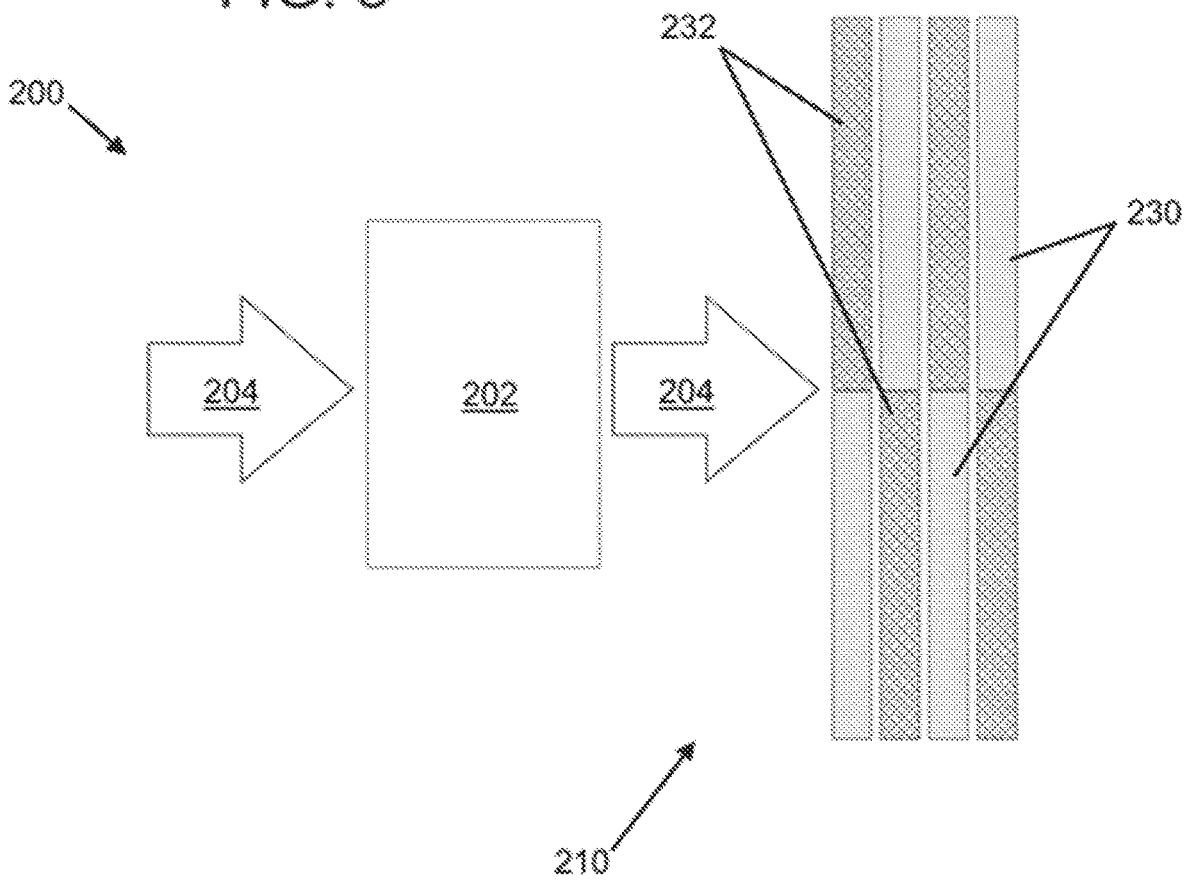
FIG. 3 is a diagram showing another embodiment of a cooling apparatus having heat exchanger modules of two coolant paths that alternate in two directions in accordance with certain aspects of the present disclosure.

While a simple alternating series pattern may be preferred in certain instances, more complicated arrangements of the cooling modules is also contemplated. For example, referring to FIG. 3, a set of first cooling modules 230 may alternate with a set of second cooling modules 232 in both the airflow direction 233 and also a second direction that is perpendicular to the airflow direction 233, forming a checkerboard pattern. This embodiment may further increase the equality of heat load responsibility for each of the first coolant path 216 and the second coolant path 218, for example. Other patterns are also contemplated.

Figure 4:
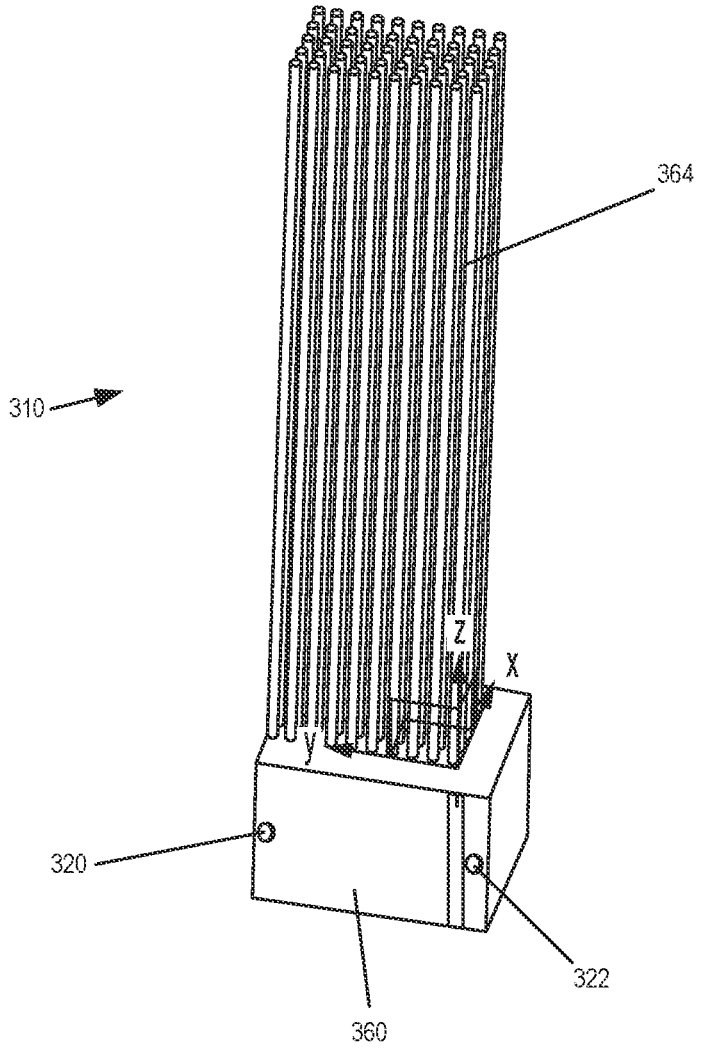
FIG. 4 is an illustration showing a perspective view of another embodiment of a heat exchanger with multiple coolant paths, where an end block is included with a divider for determining the coolant path of a plurality of cooling tubes in accordance with certain aspects of the present disclosure.
Figure 5:
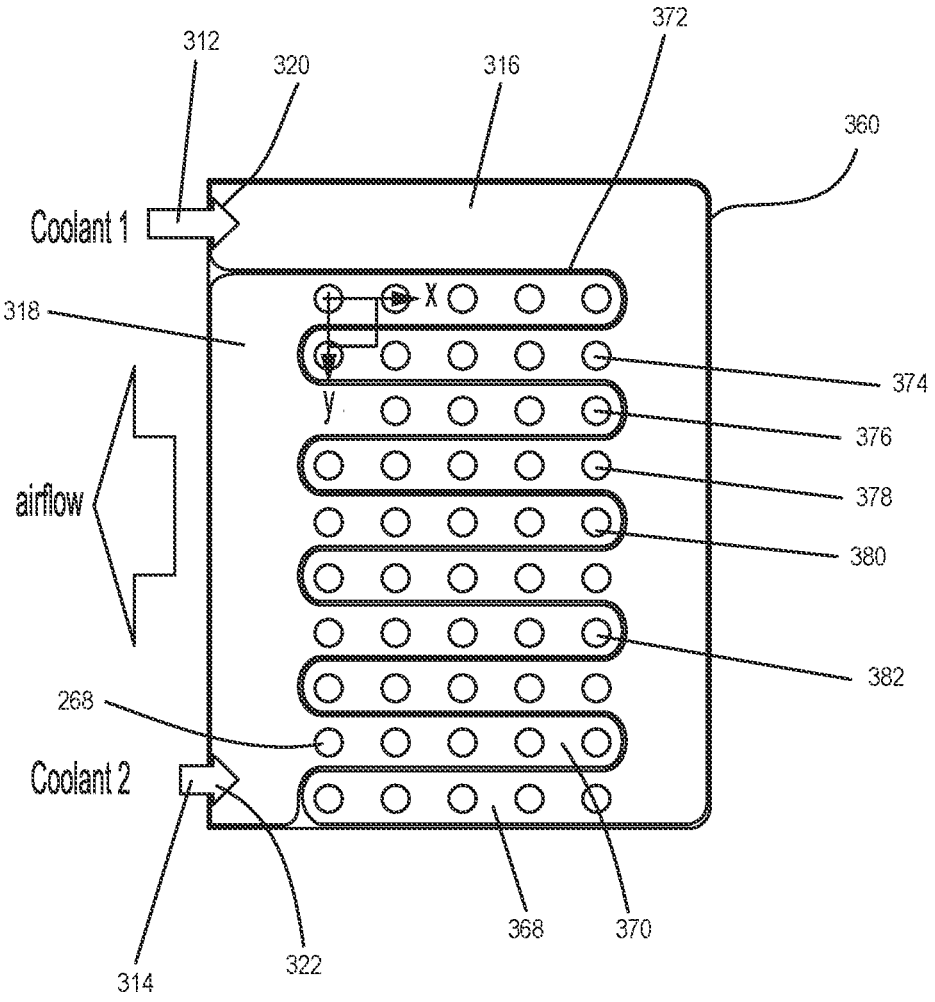
FIG. 5 is an illustration showing a top view of the heat exchanger of FIG. 4, where the divider of the end block includes a serpentine pattern in accordance with certain aspects of the present disclosure.

FIGS. 4-5 show another embodiment of a heat exchanger 310 with similar features and advantages, but without separately-formed cooling modules. Instead, the heat exchanger 310 includes common end blocks (which may be considered a manifold or other fluid-path-providing structure), depicted as a first end block 360 and a second end block 362, which accommodate the inlets and outlets of the heat exchanger 310 for receiving/exhausting the first coolant and the second coolant. Cooling tubes 364 extend from the first end block 360 to the second end block 362 and, like the embodiments above, certain cooling tubes receive the first coolant and others receive the second coolant 314.

To differentiate which cooling tubes 364 receive which coolant, the first end block 360 includes a first boundary that divides a first cavity 368 from a second cavity 370 (which are distinguished/divided portions of the cavity, or empty space, inside the first end block 360). In other words, first cooling tubes are in fluid communication with the first cavity 368 and second cooling tubes are in fluid communication with the second cavity 370. Thus, first coolant 312 flowing through the first cavity 368 also flows through the first cooling tubes of the first coolant path 316, and the second coolant 314 of the second coolant path 318 flows through the second cavity 370 and the second cooling tubes.

Figure 6:
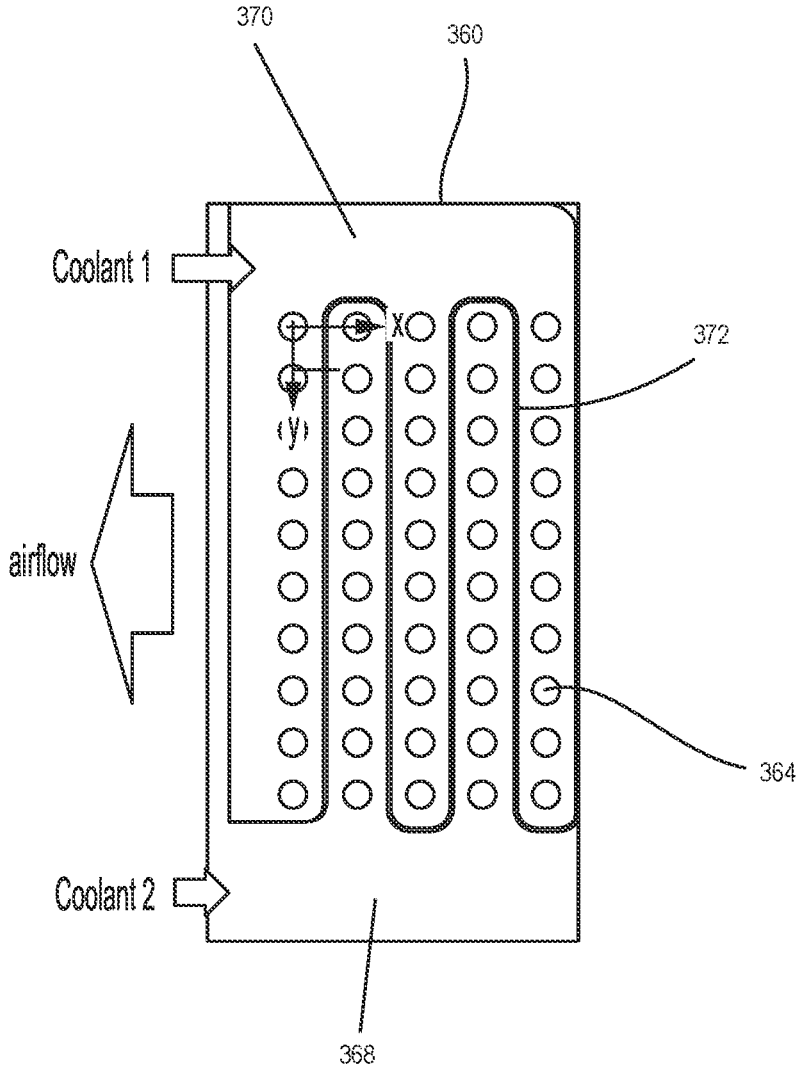
FIG. 6 is an illustration showing a top view of a variation of the heat exchanger from FIG. 4, where the divider distinguishes cooling rods of respective first and second cooling paths in accordance with certain aspects of the present disclosure.

The divider 372 may provide a fluid barrier such that mixing of the two coolants does not occur within the first end block 360. The divider's shape may also determine which cooling tubes are part of the first coolant path 316 and which are part of the second coolant path 318. For example, as shown in FIG. 5 (and also the alternate arrangement of FIG. 6), the divider 372 includes a serpentine shape such that a first row 374, third row 378, and fifth row 382 of cooling tubes are in fluid communication with the first cavity 368 and thereby a portion of the first coolant path. A second row 376 and fourth row 380 of the cooling tubes 364 are in fluid communication with the second cavity 370 and therefore a portion of the second coolant path 318. The divider's shape may be altered to accommodate any feasible pattern in accordance with the heat exchanger's design. Notably, the embodiment of FIG. 5 has tubes of the various paths alternating in a direction opposite the airflow direction, while FIG. 6 includes tubes alternating in a direction parallel to the airflow direction. Either option is contemplated by the inventors. A diagonal orientation between alternating tubes is also contemplated.

The second end block 362 may have features that are similar to those of the first end block 360. For example, the second end block 362 may have a divider that is similar in shape to the first divider 372 of the first end block 360, which may ensure that the cooling tubes do not "switch" between the various cooling paths due to incompatibilities of the first end block 360 and the second end block 362.

The first end block 360 may be associated with a first inlet 320 and a second inlet 322 of the of the respective cooling paths and the second end block 362 may be associated with the outlets, or vice versa. These inlets and/or outlets may be located on a common side/surface of the end blocks, which may enhance accessibility.

Alternatively, the first end block 360 may include a first inlet 320 for the first coolant path 316, while the second end block 362 includes a second inlet 322 for the second coolant path 318. This may advantageously cause opposite-direction flow of the first coolant 312 and the second coolant 314 through the heat exchanger 310, which may enhance the degree to which the heat load is distributed equally between the various coolant paths.

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

One general aspect includes a heat exchanger. The heat exchanger may include a first coolant path for circulating a first coolant and a second coolant path for circulating a second coolant, where the first coolant path including a plurality of first cooling tubes, where the second coolant path including a plurality of second cooling tubes, where the first coolant path is fluidly isolated from the second coolant path in the heat exchanger, and where the first cooling tubes and the second cooling tubes are arranged in series and such that the first cooling tubes alternate with the second cooling tubes in an airflow direction.

In some implementations, the heat exchanger includes a first heat exchanger module, a second heat exchanger module, and a third heat exchanger module, where the first heat exchanger module includes at least one of the first cooling tubes, where the second heat exchanger module includes at least one of the second cooling tubes, where the third heat exchanger module includes at least one of the first cooling tubes, and where the second heat exchanger module is arranged between the first heat exchanger module. The first heat exchanger module and the third heat exchanger module may each be in fluid communication with a first inlet, and where the second heat exchanger module is in fluid communication with a second inlet. The first heat exchanger module and the third heat exchanger module may each be in fluid communication with a first outlet, and where the first inlet is on an opposite side of the heat exchanger from the first outlet in a longitudinal direction of the first cooling tubes. The first inlet may also be on an opposite side of the heat exchanger from the first outlet in a direction that is perpendicular to the longitudinal direction of the first cooling tubes. The first heat exchanger module may connect to the first inlet via a first orifice interface, the first orifice interface controlling a flow rate of the first coolant. The first heat exchanger module and the second heat exchanger module may be substantially identical heat exchanger module units assembled in different orientations.

In some implementations, the first cooling tubes and the second cooling tubes extend from the first end block to the second end block, where the first end block includes a first inlet for the first coolant path, and where the second end block includes an outlet for the first coolant path. At least one of the first end block and the second end block includes a second inlet for the second coolant path. The first end block may include a coolant cavity divided into a first cavity and a second cavity by a block divider. The first cooling tubes may be in fluid communication with the first cavity, where the second cooling tubes are in fluid communication with the second cavity. The block divider may include a serpentine shape. The first end block may include a second inlet for the second coolant path, where the first inlet and the second inlet are included through a common surface of the first end block.

In some implementations, the first coolant and the second coolant are a common refrigerant. Alternatively, they may be different refrigerants.

In some implementations, the first cooling tubes and the second cooling tubes are configured such that, when two-phase cooling is utilized, a quality of the first coolant as it leaves the heat exchanger is within 30% of a quality of the second coolant as it leaves the heat exchanger during normal operation. Additionally or alternatively, the first coolant path and the second coolant path are configured such that each of the first coolant path and the second coolant path handle at least 30% of an operational heat load of the heat exchanger.

In some implementations, each of the first coolant path and the second coolant path are configured to accommodate, alone, 100% of a minimum heat exchange rate of an electronics cabinet.

Another general aspect includes a cooling apparatus that has the heat exchanger of the first aspect discussed above, where the heat exchanger is located in an airflow path to receive air that cools one or more heat-generating components. The heat exchanger removes heat from the air during the circulation. The cooling apparatus may further include a condenser located outside of the electronics cabinet and configured to remove heat from at least one of the first coolant and the second coolant.

We claim:

1. A heat exchanger, comprising:

a first coolant path for circulating a first coolant and a second coolant path for circulating a second coolant;

a first heat exchanger module;

a second heat exchanger module;

a third heat exchanger module;

a first inlet fluidically connected to the first and third heat exchanger modules;

a second inlet fluidically connected to the second heat exchanger module; and a first end block and a second end block, wherein the first coolant path including a plurality of first cooling tubes, wherein the second coolant path including a plurality of second cooling tubes, wherein the first coolant path is fluidly isolated from the second coolant path in the heat exchanger, wherein the first cooling tubes and the second cooling tubes are arranged in series and such that the first cooling tubes alternate with the second cooling tubes in an airflow direction, wherein the first heat exchanger module includes at least one of the first cooling tubes, wherein the second heat exchanger module includes at least one of the second cooling tubes, wherein the third heat exchanger module includes at least one of the first cooling tubes, wherein the second heat exchanger module is arranged between the first heat exchanger module and the third heat exchanger module, wherein the first and second inlets are on the same side of the heat exchanger in a longitudinal direction of the pluralities of first and second cooling tubes, wherein the first cooling tubes and the second cooling tubes extend from the first end block to the second end block, wherein the first end block includes a first inlet for the first coolant path, wherein the second end block includes an outlet for the first coolant path, and wherein the first end block includes a coolant cavity divided into a first cavity and a second cavity by a block divider.

2. The heat exchanger of claim 1, wherein the first heat exchanger module and the third heat exchanger module are each in fluid communication with a first outlet, and wherein the first inlet is on an opposite side of the heat exchanger from the first outlet in the longitudinal direction of the first cooling tubes.

3. The heat exchanger of claim 2, wherein the first inlet is also on an opposite side of the heat exchanger from the first outlet in a direction that is perpendicular to the longitudinal direction of the first cooling tubes.

4. The heat exchanger of claim 1, wherein the first heat exchanger module connects to the first inlet via a first orifice interface, the first orifice interface controlling a flow rate of the first coolant.

5. The heat exchanger of claim 1, wherein the first heat exchanger module and the second heat exchanger module are substantially identical heat exchanger module units assembled in different orientations.

6. The heat exchanger of claim 1, wherein at least one of the first end block and the second end block includes a second inlet for the second coolant path.

7. The heat exchanger of claim 1, wherein the first cooling tubes are in fluid communication with the first cavity, and wherein the second cooling tubes are in fluid communication with the second cavity.

8. The heat exchanger of claim 1, wherein the block divider includes a serpentine shape.

9. The heat exchanger of claim 1, wherein the first end block includes a second inlet for the second coolant path, and wherein the first inlet and the second inlet are included through a common surface of the first end block.

10. The heat exchanger of claim 1, wherein the first coolant and the second coolant are a common fluid type including one or more of water, refrigerants, or hydrocarbons.

11. The heat exchanger of claim 1, wherein the first cooling tubes and the second cooling tubes are configured such that, when two-phase cooling is utilized, a quality of the first coolant as it leaves the heat exchanger is within 30% of a quality of the second coolant as it leaves the heat exchanger during normal operation.

12. The heat exchanger of claim 1, wherein the first coolant path and the second coolant path are configured such that each of the first coolant path and the second coolant path handle at least 30% of an operational heat load of the heat exchanger.

13. The heat exchanger of claim 12, wherein each of the first coolant path and the second coolant path are configured to accommodate, alone, 100% of a minimum heat exchange rate of an electronics cabinet.

14. An electronics cabinet, comprising:

a fan configured to cause circulation of air within the electronics cabinet;

the heat exchanger in accordance with claim 1, wherein the heat exchanger removes heat from the air during the circulation; and a condenser located outside of the electronics cabinet and configured to remove heat from at least one of the first coolant and the second coolant.

15. The heat exchanger of claim 6, wherein the first end block includes the second inlet for the second coolant path.

16. A method comprising providing a first coolant path for circulating a first coolant and a second coolant path for circulating a second coolant;

providing a first heat exchanger module;

providing a second heat exchanger module;

providing a third heat exchanger module;

fluidically connecting a first inlet to the first and third heat exchanger modules;

fluidically connecting a second inlet to the second heat exchanger module;

providing a first end block and a second end block;

arranging the first cooling tubes and the second cooling tubes in series and such that the first cooling tubes alternate with the second cooling tubes in an airflow direction; and arranging the second heat exchanger module between the first heat exchanger module and the third heat exchanger module, wherein the first coolant path includes a plurality of first cooling tubes, wherein the second coolant path includes a plurality of second cooling tubes, wherein the first coolant path is fluidly isolated from the second coolant path in the heat exchanger, wherein the first heat exchanger module includes at least one of the first cooling tubes, wherein the second heat exchanger module includes at least one of the second cooling tubes, wherein the third heat exchanger module includes at least one of the first cooling tubes, wherein the first and second inlets are on the same side of the heat exchanger in a longitudinal direction of the pluralities of first and second cooling tubes, wherein the first cooling tubes and the second cooling tubes extend from the first end block to the second end block, wherein the first end block includes a first inlet for the first coolant path, wherein the second end block includes an outlet for the first coolant path, and wherein the first end block includes a coolant cavity divided into a first cavity and a second cavity by a block divider.

* * * * *